United States Patent [19]

Smith et al.

[11] 4,269,242

[45] May 26, 1981

[54] COMBINATION LOG CUTTER, SPLITTER AND BUNDLER

[76] Inventors: Clark K. Smith, 5406 Wedding Ct., Waldorf, Md. 20601; Harry W. Staley, 4338 Harney Rd., Taneytown, Md. 21787

[21] Appl. No.: 866,846

[22] Filed: Jan. 4, 1978

[51] Int. Cl.[3] ..... B27L 7/00

[52] U.S. Cl. ..... 144/192; 83/370; 83/471.2; 144/3 K; 144/193 A; 144/326 R

[58] Field of Search ..... 83/370, 471.2; 144/3 K, 144/193 R, 193 A, 323, 312, 326 R, 192; 198/825, 826, 835

[56] References Cited

U.S. PATENT DOCUMENTS

| | | | |
|---|---|---|---|
| 1,001,272 | 8/1911 | Howard | 144/3 K |
| 1,441,996 | 1/1923 | Mukai | 144/193 R |
| 1,598,695 | 9/1926 | Anderson | 144/3 K |
| 1,985,462 | 12/1934 | Schapiro | 144/192 |
| 2,623,587 | 12/1952 | Hervay | 83/370 X |
| 3,414,027 | 12/1968 | Larva, Sr. et al. | 144/312 X |
| 3,500,882 | 3/1970 | Tanquay | 144/312 |
| 3,548,895 | 12/1970 | Gentry, Jr. | 83/471.2 |
| 3,596,691 | 8/1971 | Broadfoot | 144/312 X |
| 3,759,124 | 9/1973 | Bashor | 83/471.2 |
| 3,862,651 | 1/1975 | Heikkinen | 144/3 K |
| 4,032,002 | 6/1977 | Jackson | 198/825 |
| 4,076,061 | 2/1978 | Greeninger | 144/193 A |
| 4,173,237 | 11/1979 | Heikkinen et al. | 144/193 A |

*Primary Examiner*—W. Donald Bray
*Attorney, Agent, or Firm*—Blair, Brown & Kreten

[57] ABSTRACT

Disclosed herein is a combination log cutter, splitter and bundler for reducing in size logs, preferably to a fireplace length. In addition disclosed herein is a portable device which in one operation saws the wood to an appropriate length, splits the wood, and then bundles it.

9 Claims, 10 Drawing Figures

FIG. 5.
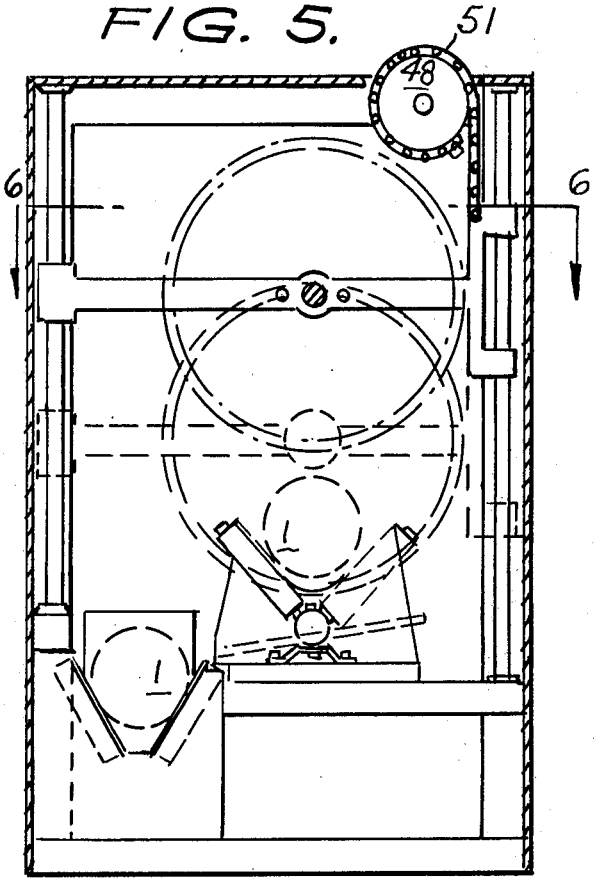
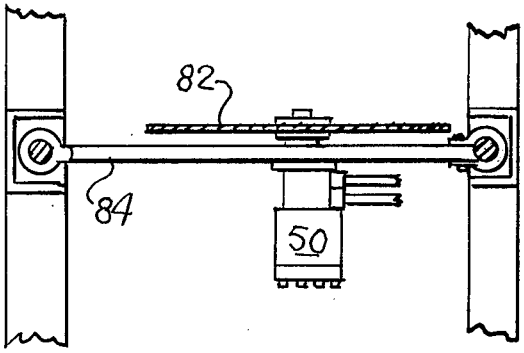
FIG. 6.
FIG. 10.
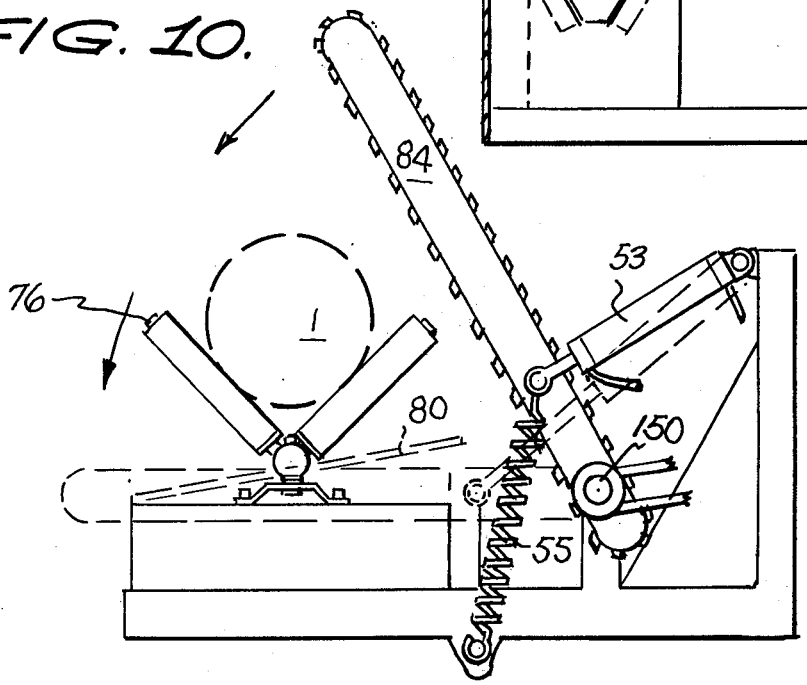

COMBINATION LOG CUTTER, SPLITTER AND BUNDLER

BACKGROUND OF THE INVENTION

1. Field of the Invention

This invention relates generally to an integral unit which can be transported to a forested site, to reduce timber generally regarded as cull wood into split lengths suitable for firewood or similar uses.

2. Summary of the Invention

In the past when land is to be cleared for new construction or similar uses for example clearing for farm land, right of ways etc., the big lumber has been trucked off to a saw mill to be reduced to useable lumber. However a problem has existed with trees of intermediate size, that is trees whose diameter ranges roughly from 6 to 12 inches. In addition, in present forestry practice for thinning over-populated standing wood lots, the culled trees are killed, left standing to eventually fall and rot away. These trees are not large enough for the saw mill and prove an inconvenience in terms of disposing of them efficiently.

The present invention provides a portable unit which can be taken directly to the deforestation site and can reduce this cull wood which has generally gone to waste into useable firewood.

Accordingly, the present invention overcomes the aforementioned difficulties by providing a unit on a single chassis which is capable of taking these logs of intermediate size and reducing them into a useable product without the disadvantages attendant in the prior art. Whereas previously this firewood making operation had to be done manually, or has been only partially mechanized, this unit can, in one operation reduce to fireplace length, or any other length for that matter, split and gather in a bundling device culled wood which heretofore has been inefficiently processed, if used at all.

OBJECTS OF THE INVENTION

It is an object of this invention to provide an integral log cutter, splitter, and bundler which is portable.

It is another object of this invention to provide a device as specified above in which all of these operations are performed automatically.

It is a further object of this invention to provide a device as set forth above which can do all of these operations on one chassis.

These and other objects will become apparent in the following specification when considered in light of the attached drawings.

BRIEF DESCRIPTION OF THE DRAWINGS

FIG. 5 shows some of the details of the guillotinee type sawing mechanism;

FIG. 6 is a top view of the mechanism shown in FIG. 5;

FIG. 10 shows an alternative embodiment of the sawing mechanism shown in FIGS. 5 and 6.

DESCRIPTION OF THE PREFERRED EMBODIMENT

Figure 1:
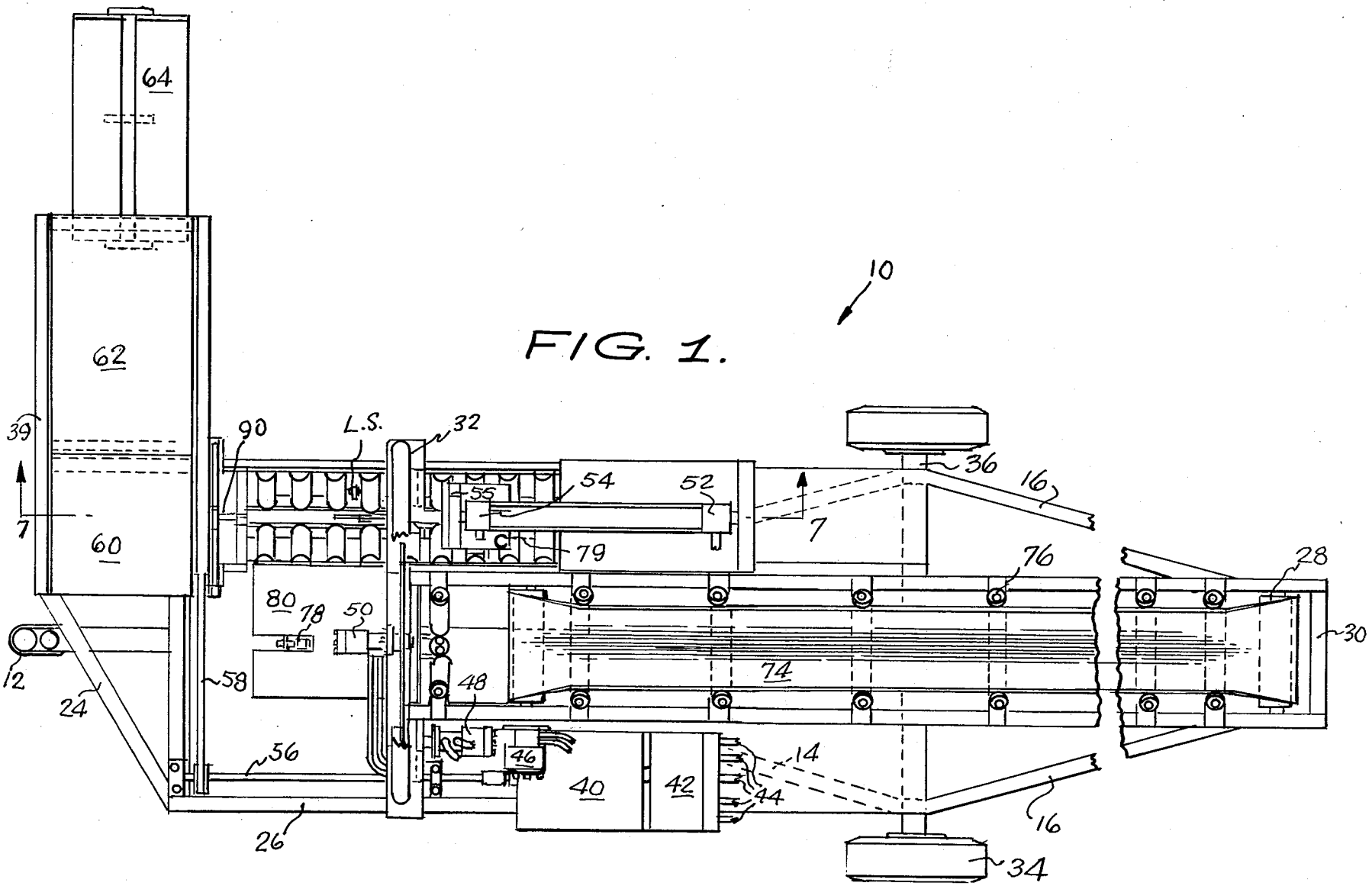
FIG. 1 is a top plan view of the mobile combination log cutter, splitter and bundler.

Referring to the drawings in which like numerals indicate like parts throughout the drawings the reference numeral 10 generally denotes the combination log cutter, splitter and bundler.

The apparatus of the instant invention may be conveniently regarded as four sub-stations carried on a major portable frame. There is a log conveying station defined by numerals 74 for the belt portion and 76 for the roller portion in which logs of any length, but of a medium thickness, are to be transported to the cutting station which is denoted by numeral 150 and 82 of FIG. 6, and 84 of FIG. 10. Thereafter the logs which have been cut to an arbitrary length are rolled to another station for splitting in which ram 55 is activated by preferably a hydraulic ram unit 54 and 52 and pushes the log which has been cut through the splitting station denoted by numeral 90 best seen in FIGS. 1 and 2. Thereafter they are conveyed by means of belts 60 and 62 into a bundler unit generally denoted by 64. All of these sub-stations and sub-operations are carried on a single frame which is portable and can be moved from location to location by means of trailer hitch 12 seen best in FIG. 2.

Figure 2:
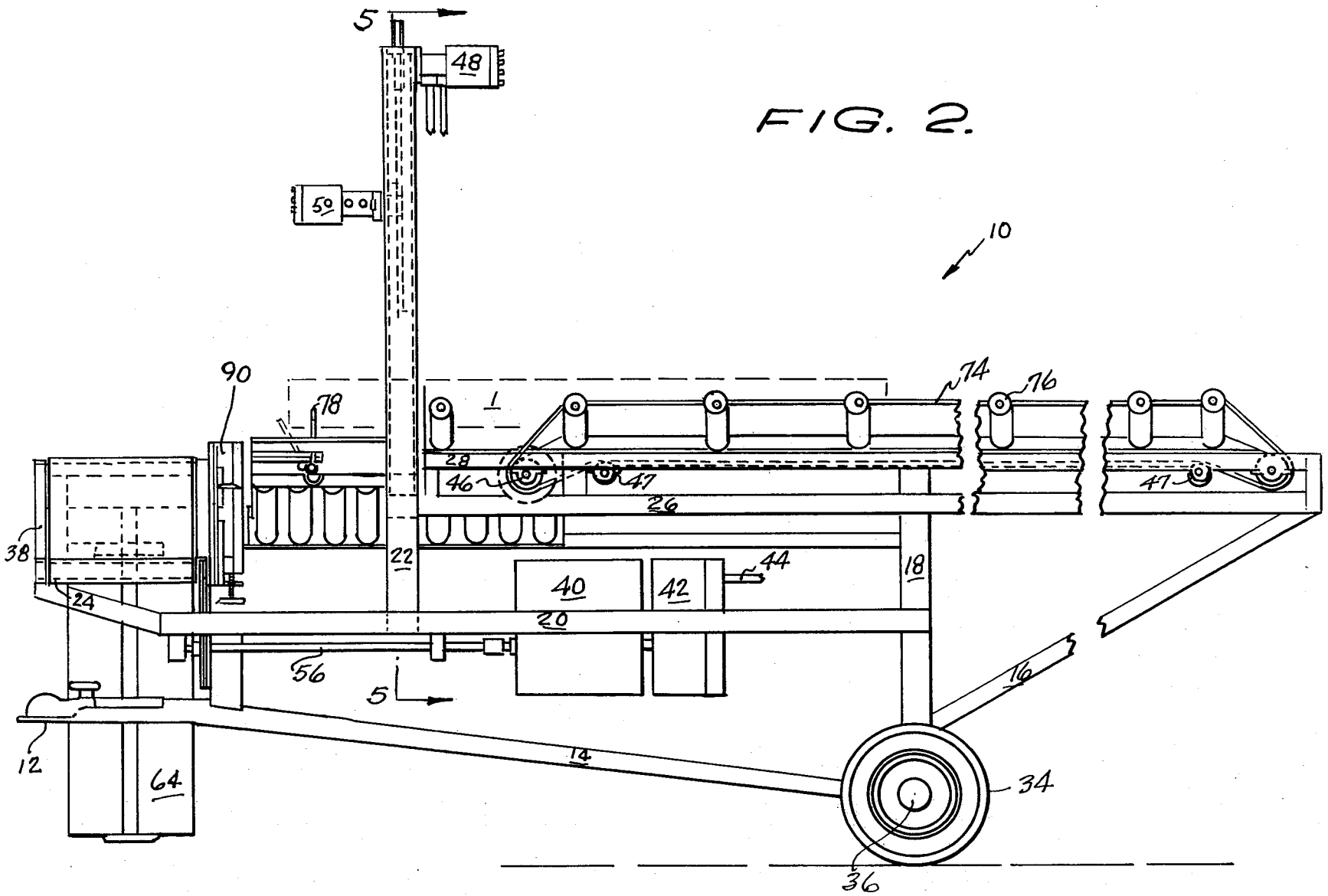
FIG. 2 is a side view thereof.

Specifically, the mechanism 10 is supported by a frame lattice work which is carried by wheels 34 of FIGS. 1 and 2 which are supported on an axle 36. Frame members which form the undercarriage along with the trailer hitch 12 include bars 14,16,18,20,22,24,26,28, and 30. These form the framework upon which the sub-stations are to be supported.

All of the sub-stations derive their requisite power from one source: namely engine 40 which is of any conventional type engine. This engine is connected to a drive shaft 56 and its function will be hereinafter explained at one output station, and is used to drive hydraulic pump 42 which as seen in FIG. 1 has a plurality of outlets and inlets.

Regarding the log conveying assembly, the hydraulic pump is operatively connected to a servomotor denoted by 46 FIGS. 1 and 2 which drives the conveyor 74 which is supported in turn on rabbit ear shaped rollers 76. The configuration of these rollers 76 is such that they provide a substantially U-shaped trough for carrying the uncut log.

Figure 4:
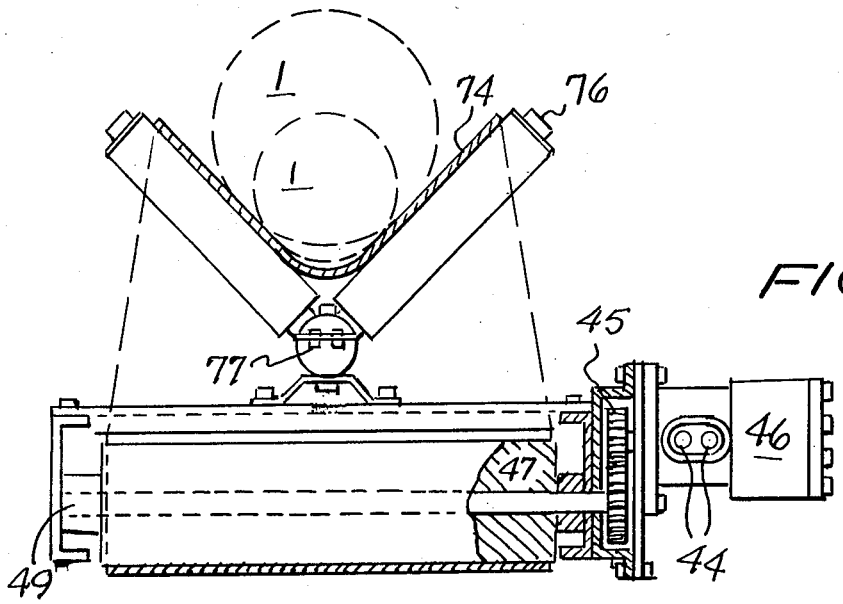
FIG. 4 is a detailed view of the log carrying mechanism.

FIG. 4 best depicts the connection between servomotor 46 coupled by hydraulic lines 44 to the main hydraulic pump 42 and its actuation of the conveyor system. Numeral 45 generally denotes a gear or chain drive mechanism which rotates axle 49 which is suitably supported on the frame of the trailer unit, and this powers roller 47 which in turn drives flexible belt 74 over the rollers 76. Logs of different diameters therefore can be carried and transported along this conveyor as depicted by the various logs 1 shown in phantom on FIG. 4. Rollers 76 are supported on the frame carriage assembly of the portable unit via support member 77 which is suitably bolted to the frame.

FIGS. 1, 2, 3, 5, and 6 show the operation of the sawing station, and FIG. 10 shows an alternative embodiment to the actual sawing mechanism.

Figure 3:
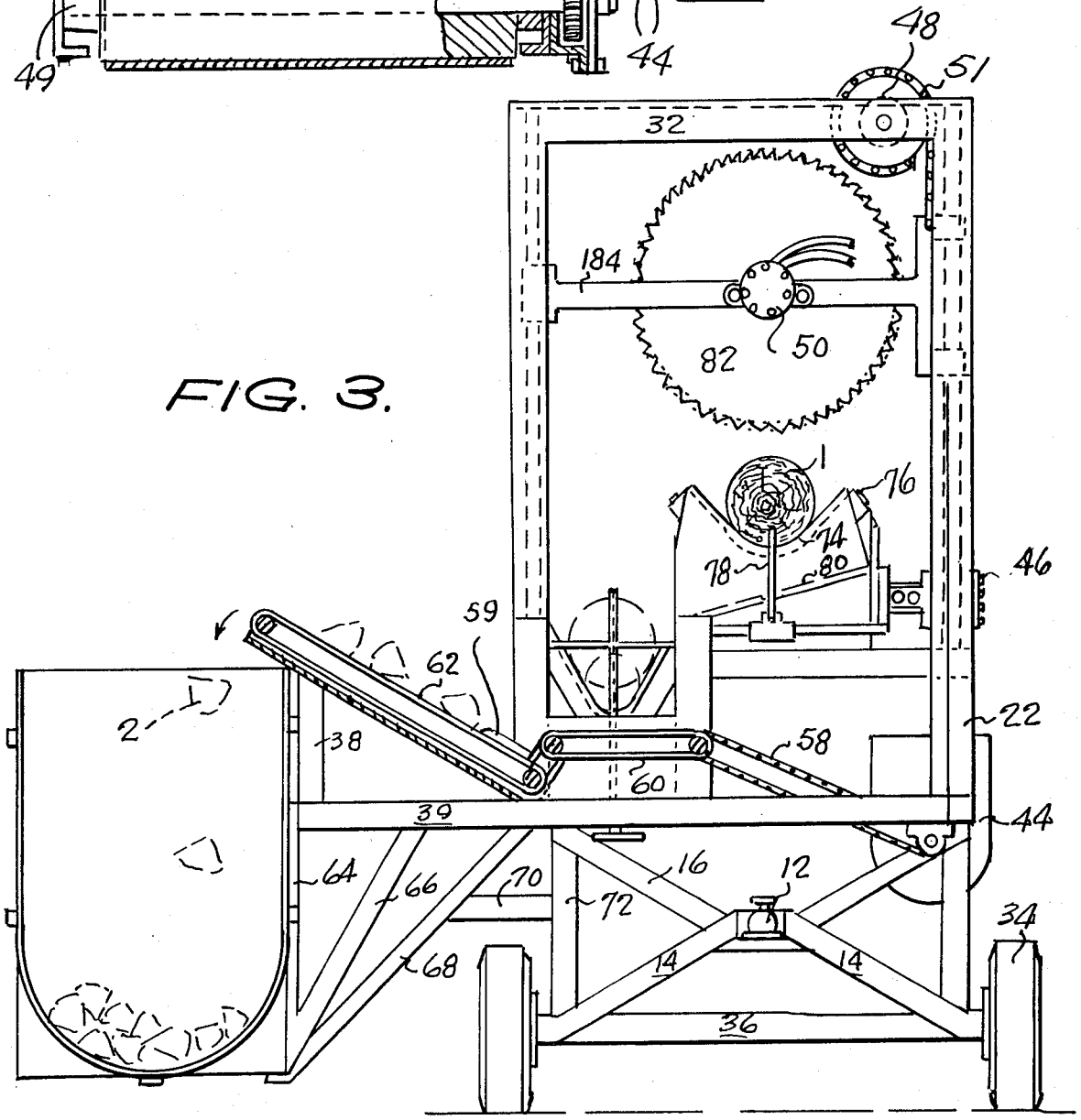
FIG. 3 is an end view showing the bundling and conveying mechanism as well as the saw and splitting mechanisms.
Figure 7:
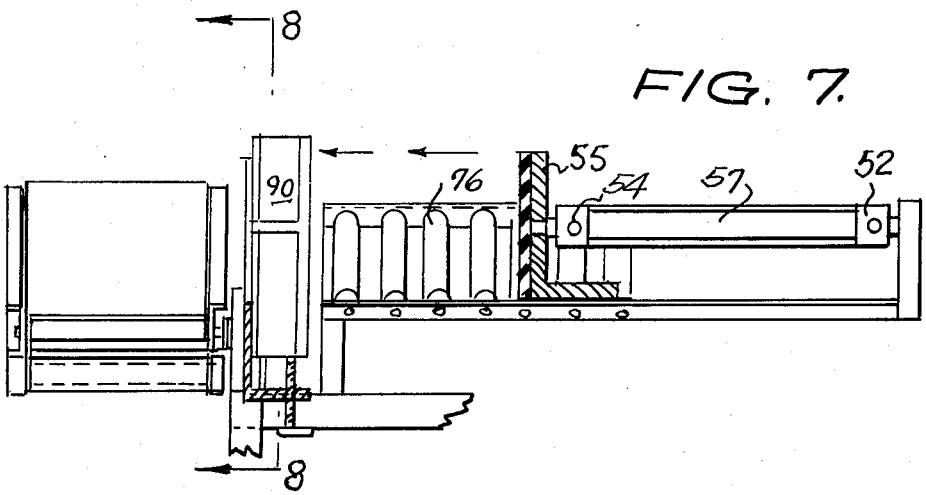
FIG. 7 is a side view showing the hydraulic ram splitting mechanism.
Figure 8:
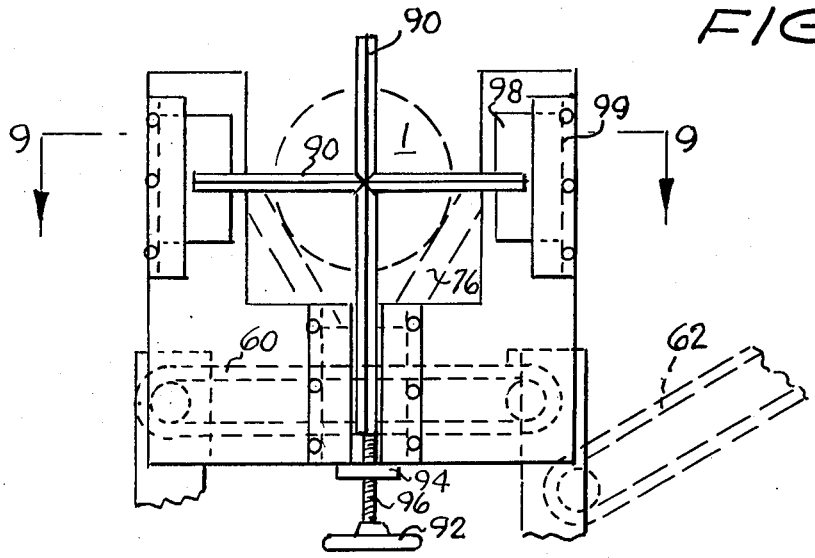
FIG. 8 is an end view taken along the lines 8—8 of FIG. 7 showing the splitting mechanism and conveying system in phantom.

As the uncut log 1 travels along conveyor 74 it is pushed underneath the cutting station denoted by 82 in FIG. 3 and 84 in FIG. 10 where it engages a limit switch 78. This limit switch 78 is adjustable to provide cut logs of different lengths. When the switch is in the depressed position as shown in phantom in FIG. 2 the limit switch causes conveyor 74 to stop. At this time servomotors 48 and 50 are activated. Motor 48 is connected to the chain 51 which raises and lowers the saw mechanism of FIG. 3 since the chain mechanism 51 is connected to cross bar support 184 upon which saw blade 82 is carried. At the same time servomotor 50 is energized causing the saw blade to rotate. In FIG. 10 there is shown an alternative embodiment, in which hydraulic mechanism 53 also operatively connected to hydraulic pump 42 causes machine saw 84 to pivot about point 150 which is a motor similar to the one in FIG. 3. Hydraulic mechanism 53 is biased by means of springs 55, and as the cutting blade 84 in FIG. 10, or 82 in FIG. 3 moves down on the log 1 a cut is made on the log separating this smaller piece from the remainder of the log. When the cut is complete, the log will fall onto tray 80 which is inclined and the log will roll down into a trough provided at the end of the incline. This will permit limit switch 78 to return to its original position, and the incremental feeding of the log on the conveyor 74 can recommence.

Simultaneously with this operation however, the cut log element rolling down tray 80 has fallen into a new trough which has rollers similar to the rolling elements 76 of the conveyor. The presence of the log in this V-shaped trough activates a second limit switch L.S. which starts action of the ram 55 by its being operatively connected to motor element 40 through hydraulic pump 42. The ram is extended by introducing fluid into chamber 57 of the ram and 55, the face of the ram which abutts against the wall when the ram is fully extended pushed the log against the splitting station generally denoted by numeral 90 of FIGS. 1,7,8 and 9.

The splitting station denoted by numeral 90 is generally regarded as a cross-shaped wedge member whose tapered edge faces at the logs to be split. Its height is adjustable to accommodate logs of different diameters by means of hand wheel 92 of FIG. 8 which cooperates with worm gear 96 through member 94 to raise or lower the splitting mechanism 90 relative to the log member 1. This is brought about by the vertical displacement of member 98 relative to 99 which is supported on the frame network.

As the log gets pushed through the splitting station, limit switch L.S. returns to its original configuration, and ram member 55 is retracted to its original position. A further limit switch denoted by numeral 79 senses the return of the ram to its original position, and stops the flow of oil to the ram generally denoted as 52 and 54 of FIG. 1.

Figure 9:
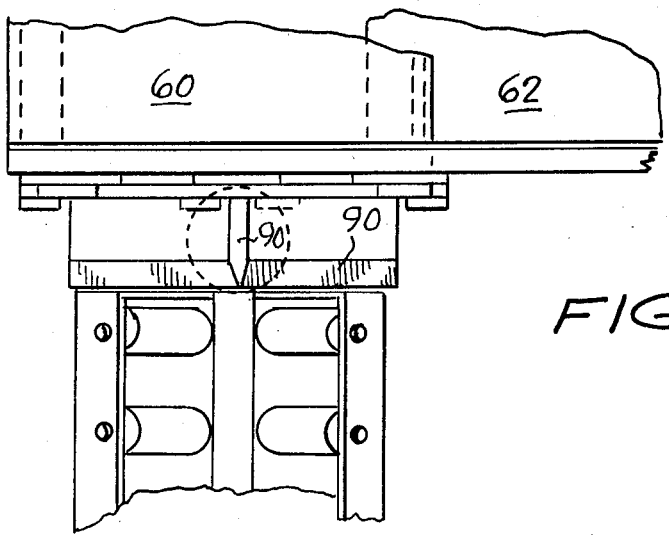
FIG. 9 is a top plan view of the splitting mechanism taken along the lines 9—9 of FIG. 8.

The log which has thus been quartered, by virtue of its being driven through cross-shaped wedge mechanism 90, thereafter is deposited on a conveyor generally denoted by numeral 60 best seen in FIGS. 1, 3 and 9.

Conveyor 60 is shown as being chain driven as through 58, which in turn is driven by axle 56 which operates directly from motor 40, and is in continuous operation. As an alternative the conveyor can be driven by hydraulic motor deriving its power from the engine 40 through the hydraulic pump 42. Also connected to conveyor 60 through an additional link member 59 is a second conveyor 62 which carries the quartered wood into a bundling hopper 64. The bundling hopper 64 is generally U-shaped in configuration and provides an automatic stacking device for orienting the wood in easily transportable units.

Generally denoted by numerals 38, 39, 66, 68, 70 and 72 are framework which is used to support the previously described conveying system.

In view of the foregoing, it will be appreciated that once the initial adjustments have been made to determine at what length the logs are to be cut, and also to make an adjustment for the wedge to accommodate logs of certain diameters, that an entire log can be cut and quartered without any subsequent adjustments. Further when a subsequent log is placed on conveyor 74, the only adjustment necessary is to change the wedge orientation to accommodate the new diameter.

Having thus described the preferred embodiments of the invention it should be understood that numerous structural modifications and adaptations may be resorted to without departing from the spirit of the invention.

What is claimed is:

1. A trailer for cutting, spliting and bundling logs of indeterminate length comprising a trailer hitch, a frame network attached to said trailer hitch, a pair of wheels carried on an axle supporting said frame network remote from said trailer hitch, a first conveyor disposed on said frame network for conveying logs of indeterminate length to a cutting station also disposed on said frame network, a first limit switch disposed on said frame network to stop said log conveyor and actuate a saw defining said cutting station when the log enters said cutting station, a tray disposed on said frame network oriented to receive a log element that has been cut at said cutting station and inclined from a horizontal plane whereby the log element will roll down said tray onto, a second conveyor disposed on said frame network having a second limit switch which senses the presence of said cut log element when the log element rolls thereon, a ram means disposed on said frame network axially aligned with said second conveyor and said cut log element activated by said second limit switch, splitting means axially aligned with said cut log element opposite from said ram means, whereby said ram means forces said cut log element through said splitting means to provide a plurality of split wood elements, return means to return said ram to its initial position upon splitting said cut log element, and a third conveyor for removing said split, cut wood elements away from said splitting station to bundling means disposed at the terminal point of said conveying means to receive and bundle said split, cut wood elements said bundling means defined by a substantially U-shaped hopper so that the log elements tend to stack uniformly therein.

2. The apparatus of claim 1 in which said first and third conveyors, said saw means, and said ram means are all connected to a single motor source.

3. The device of claim 1 in which said saw means comprises a vertically displaceable circular saw.

4. The device of claim 1 in which said saw means comprises a chain saw pivoted at one extremity.

5. The device of claim 1 in which said third conveyor is supported on said frame network.

6. The device of claim 1 in which said bundling means is supported on said frame network.

7. The device of claim 1 in which said first conveyor comprises a plurality of rollers oriented in a substantial V-shape configuration, having a driven belt of troughed configuration disposed thereon.

8. The device of claim 1 in which said ram return means comprises said second limit switch and a third limit switch which senses the return of the ram to an unextended state.

9. The device of claim 1 in which said splitting means is a wedge of substantially cross shaped configuration, which splits said cut log element into quarters.

* * * * *